US007602342B2

(12) United States Patent
Schack et al.

(10) Patent No.: US 7,602,342 B2
(45) Date of Patent: Oct. 13, 2009

(54) FOLDABLE MOBILE TELEPHONE TERMINAL WITH ANTENNA AND GROUND PLANE MADE IN ONE PIECE

(75) Inventors: Göran Schack, Åhus (SE); Pernilla Jonsson, Malmö (SE); Olof Simonsson, Malmö (SE)

(73) Assignee: Sony Ericsson Mobile Communications AB, Lund (SE)

( * ) Notice: Subject to any disclaimer, the term of this patent is extended or adjusted under 35 U.S.C. 154(b) by 141 days.

(21) Appl. No.: 10/591,818

(22) PCT Filed: Feb. 16, 2005

(86) PCT No.: PCT/EP2005/001557

§ 371 (c)(1),
(2), (4) Date: Sep. 6, 2006

(87) PCT Pub. No.: WO2005/096436

PCT Pub. Date: Oct. 13, 2005

(65) Prior Publication Data

US 2007/0200771 A1 Aug. 30, 2007

Related U.S. Application Data

(60) Provisional application No. 60/554,282, filed on Mar. 18, 2004.

(30) Foreign Application Priority Data

Mar. 12, 2004 (EP) ..... 04005861

(51) Int. Cl.
*H01Q 1/24* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS 6,049,314 A * 4/2000 Munson et al. ..... 343/846

(Continued)

FOREIGN PATENT DOCUMENTS

EP 1 306 922 A2 5/2003

(Continued)

OTHER PUBLICATIONS

Viratelle et al. "Dual-band printed antenna for mobile telephone applications", *IEE Proc.-Microw. Antennas Propag.*147(5):381-384 (2000).

(Continued)

*Primary Examiner*—HoangAnh T Le
(74) *Attorney, Agent, or Firm*—Myers Bigel Sibley & Sajovec, PA

(57) ABSTRACT

The present invention relates to a portable communication device and an antenna system. The device comprises an antenna feeding circuit and at least a first part having a hollow interior where different electrical elements are provided and provided with a main section having a certain width, length and a first height, and an antenna system. The antenna system comprises a ground plane (22, 24) located within and extending along essentially the whole width and length of at least the main section and an antenna element (28) located within the first part. The ground plane is provided in one piece and the only electrical elements of the first part being electrically connected to say ground plane are radio transmission elements.

9 Claims, 2 Drawing Sheets

U.S. PATENT DOCUMENTS

| | | | | |
|---|---|---|---|---|
| 6,133,883 | A * | 10/2000 | Munson et al. | 343/700 MS |
| 6,272,356 | B1 | 8/2001 | Dolman et al. | |
| 7,339,530 | B2 * | 3/2008 | Ying et al. | 343/702 |
| 2001/0040529 | A1 * | 11/2001 | Cheng et al. | 343/702 |
| 2003/0117324 | A1 * | 6/2003 | Iwai et al. | 343/702 |
| 2004/0125042 | A1 * | 7/2004 | Annamaa et al. | 343/895 |
| 2004/0160369 | A1 * | 8/2004 | Wong et al. | 343/702 |
| 2004/0174306 | A1 * | 9/2004 | Katoh et al. | 343/702 |
| 2004/0183732 | A1 * | 9/2004 | Konishi et al. | 343/702 |

FOREIGN PATENT DOCUMENTS

| | | | |
|---|---|---|---|
| EP | 1306922 | A2 | 5/2003 |
| GB | 2 333 902 | A | 8/1999 |
| GB | 2333902 | A | 8/1999 |

OTHER PUBLICATIONS

International Search Report corresponding to PCT/EP2005/001557 mailed Apr. 5, 2005.

International Preliminary Report on Patentability for PCT/EP2005/001557 dated Jun. 28, 2006.

Viratelle et al., "Dual-Band Printed Antenna for Mobile Telephone Applications", IEE Proceedings —H. Microwaves, Antennas & Propagation, vol. 147:5, pp. 381-384 (Oct. 2000).

International Search Report and Written Opinion (11 pages.) corresponding to International Application No. PCT/EP2005/001557; Mailing Date: Apr. 5, 2005.

European Search Report and Written Opinion (7 pages) corresponding to European Application No. EP04005861.2; Dated: Aug. 10, 2004.

* cited by examiner

FOLDABLE MOBILE TELEPHONE TERMINAL WITH ANTENNA AND GROUND PLANE MADE IN ONE PIECE

CROSS-REFERENCE TO RELATED APPLICATIONS

This application claims priority under 35 U.S.C. § 371 from PCT Application No. PCT/EP2005/001557, filed in English on Feb. 16, 2005, which claims priority from European Patent Application Serial No. 04005861.2 filed on Mar. 12, 2004, and U.S. Provisional Application Ser. No. 60/554,282 filed on Mar. 18, 2004, the disclosures and contents of which are incorporated by reference herein in their entireties. The above-referenced PCT International Application was published in the English language as International Publication No. WO 2005/096436.

TECHNICAL FIELD OF THE INVENTION

The present invention relates to the field of antennas and more particularly to a portable communication device including an in-built antenna as well as an antenna system.

DESCRIPTION OF RELATED ART

There is a trend within the field of portable communicating devices, and especially within the field of cellular phones to have the antenna in-built In the phone itself. The phones are also becoming smaller and smaller, with a need to use the space of the phone as effectively as possible. At the same time the phones have more and more functions and features and therefore also more components provided in them. Due to this fact it is hard to get antennas with a good performance, which is especially the case for clamshell type phones using PIFA antennas. The reason for this worsened performance is that the ground plane used has many connection points to the many different components used. This combined with the small size of the ground plane degrades the performance of the antenna.

WO-02/37600 describes one type of antenna in the form of a terminal chassis being fed against a counterpoise.

There also exist antenna solutions, where an antenna element is provided in a hinging section. One such solution is described in U.S. Pat. No. 6,272,356, where a spring member within a hinging section of a cellular phone is used as an antenna element.

There is therefore a need for providing an in-built antenna for a portable communication device, which provides an enhanced performance compared to previous antenna solutions.

SUMMARY OF THE INVENTION

One object of the present invention is thus to provide a portable communication device having an in-built antenna, where the degraded performance because of a multitude of connections to a ground plane is eliminated.

According to a first aspect of the present invention, this object is achieved by a portable communication device comprising:

an antenna feeding circuit, at least a first part having a hollow interior and provided with a main section having a certain width, length and a first height and where different electrical elements are provided, and an antenna system comprising:

a ground plane located within and extending along essentially the whole width and length of at least the main section, and an antenna element located within the first part, wherein said ground plane is provided in one piece and the only electrical elements of the first part being electrically connected to said ground plane are radio transmission elements.

A second aspect of the present invention is directed towards a portable communication device including the features of the first aspect, wherein said antenna element is distanced from the ground plane with at least approximately the first height in a height direction of the first part.

A third aspect of the present invention is directed towards a portable communication device including the features of the first aspect wherein the antenna ground plane and the antenna element are provided from the same piece of material.

A fourth aspect of the present invention is directed towards a portable communication device including the features of the first aspect, wherein the ground plane and the antenna element are provided on one and the same substrate.

A fifth aspect of the present invention is directed towards a portable communication device including the features of the first aspect, wherein the ground plane is provided on a substrate provided for a user interface arranged in said first part.

A sixth aspect of the present invention is directed towards a portable communication device including the features of the first aspect, further comprising a second part and wherein the first part has a hinging section, for providing rotation of the first part in relation to said second part around an axis of rotation.

A seventh aspect of the present invention is directed towards a portable communication device including the features of the sixth aspect, wherein the ground plane is connected to the second part, preferably via the hinging section, for providing a common ground potential In both parts.

An eighth aspect of the present invention is directed towards a portable communication device including the features of the seventh aspect, wherein the antenna feeding circuit is provided in the second part.

A ninth aspect of the present invention is directed towards a portable communication device Including the features of the sixth aspect, wherein the hinging section is hollow and has a second higher height and said antenna element is provided inside the hinging section.

A tenth aspect of the present invention is directed towards a portable communication device including the features of the sixth aspect, wherein the ground plane stretches into the hinging section.

An eleventh aspect of the present invention is directed towards a portable communication device including the features of the tenth aspect, wherein the ground plane is provided with a bent section provided within the hinging section and bent away from the part of the ground plane provided in the main section for providing an increased distance between the ground plane and the antenna element in the hinge cavity corresponding to the second height.

A twelfth aspect of the present invention is directed towards a portable communication device including the features of the first aspect, wherein the antenna element is a multiband antenna element.

A thirteenth aspect of the present invention is directed towards a portable communication device including the features of the first aspect, wherein the antenna element is a PIFA antenna element.

A fourteenth aspect of the present invention is directed towards a portable communication device including the features of the first aspect, wherein the antenna element is a monopole antenna element.

A fifteenth aspect of the present invention is directed towards a portable communication device including the features of the first aspect, wherein it is a cellular phone.

Another object of the present invention is to provide an antenna system, for provision inside a portable communication device, where the degraded performance because of a multitude of connections to a ground plane is eliminated.

According to a sixteenth aspect of the present invention, this object is achieved by an antenna system for provision in a portable communication device, the device having an antenna feeding circuit and a first part with a hollow interior and provided with a main section having a certain width, length and a first height where different electrical elements are provided, and comprising:

a ground plane located within and extending along essentially the whole width and length of at least the main section, and an antenna element located within the first part, wherein said ground plane is provided in one piece and the only electrical elements of the first part having electrical connections to said ground plane are radio transmission elements.

The expression radio transmission elements is intended to Include such elements as radiating antenna elements and antenna feeding circuit for driving such antenna elements.

The Invention has the following advantages. It Is cheap to produce. The provision of the ground plane as a single unit with as few connections as possible to the rest of the first part makes the antenna system more efficient than ordinary antennas in portable communication devices.

It should be emphasized that the term "comprises/comprising" when used in this specification is taken to specify the presence of stated features, integers, steps or components, but does not preclude the presence or addition of one or more other features, Integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

A portable communication device according to the present invention will now be described in relation to a cellular phone, which is a preferred variation of the invention. The phone is furthermore preferably a so-called clamshell phone, but it can be other types of phones like stick-type phones. The portable communication device can also be another type of device, like a cordless phone, a communication module, a PDA or any other type of portable device communicating with radio waves.

Figure 1:
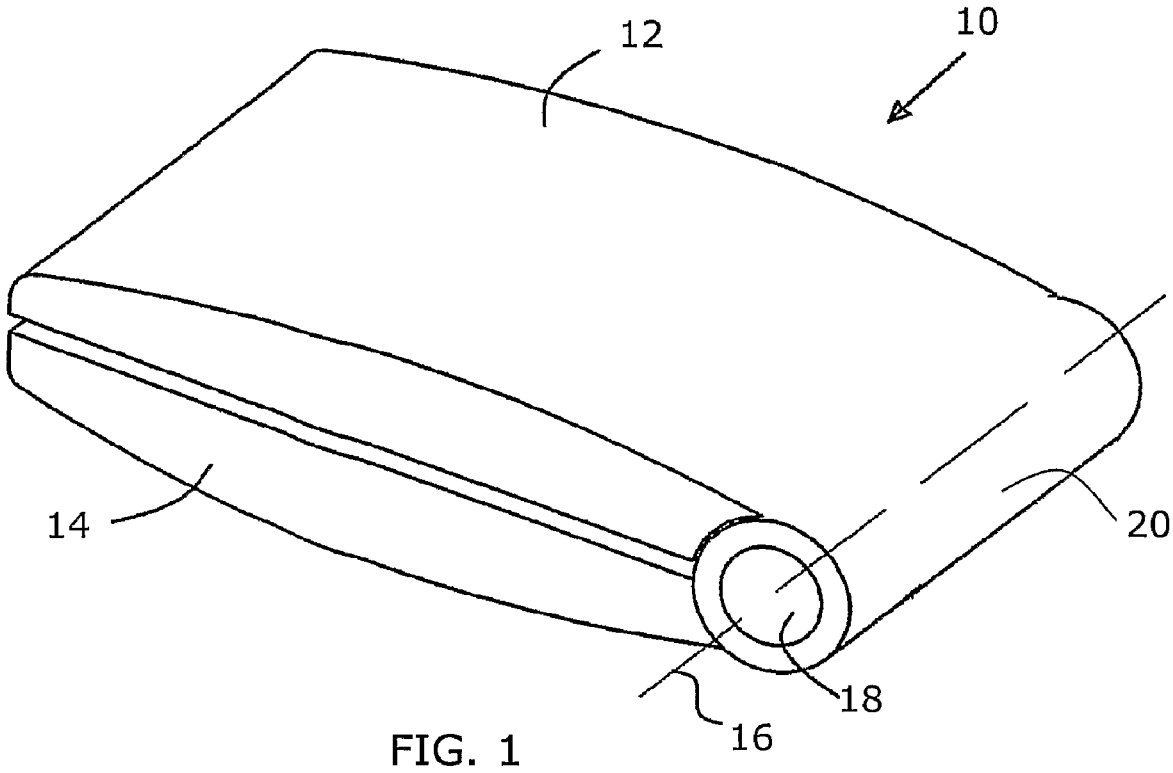
FIG. 1 schematically shows a perspective view of a clamshell phone according to the Invention in a closed position.

FIG. 1 schematically shows a perspective view of a clamshell phone according to the invention. The phone 10 includes a first and a second part 12 and 14, where the second part 14 can be rotated round the bottom end of the first part 12. The phone is for this reason provided with a hinging section 20 defining an axis 16 of rotation provided along the bottom end of the phone. The hinging section 20 therefore stretches along a bottom end of both the first and the second parts. The first and second parts 12 and 14 are joined to each other by conventional hinging elements provided in the hinging section 20. The hinge is normally provided by providing two taps, of which one 18 is shown, extending in opposite directions along the axis 16 In the second part 14, which taps mate with corresponding recesses in the first part 12, which recesses are thus provided on different sides of the taps along the axis. The taps are here provided on each side of an essentially cylindrical body having a hollow cavity provided in the first part. It should however be realised that the opposite hinge solution could be used with taps arranged in the first part and corresponding recesses in the second part. Other types of hinges are of course equally as well possible. In the figure the phone is shown in a closed position. Here it is worth noting that there is no antenna protruding from the phone. The antenna is in-built.

Figure 2:
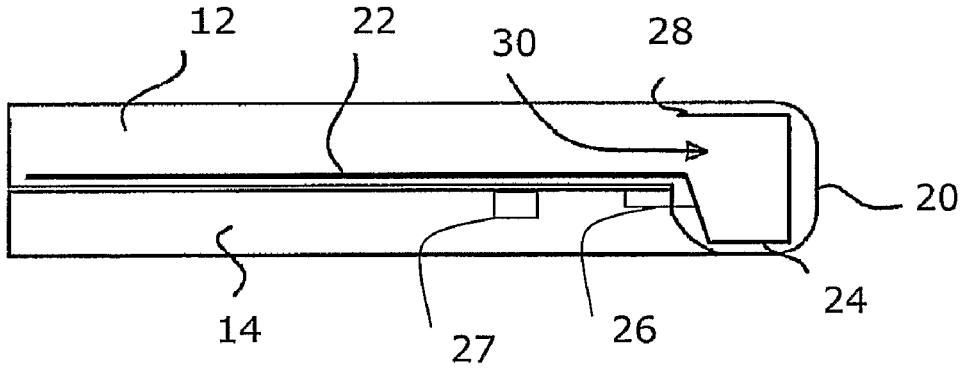
FIG. 2 shows a side view of an antenna system according to a first embodiment of the invention comprising an antenna element and ground plane provided in a first part of the clamshell phone.

FIG. 2 schematically shows a side view of the phone according to a first embodiment of the invention, where the relevant elements are shown. The first part has a certain length and width. The interior of the first part is hollow and it comprises a main section with a first height in a height direction, upwards In the figure. The interior of the main section is joined to a cavity 30 of the hinging section 20, which hinging section 20 has a second height in the height direction, that is substantially the same height as the combined heights of the first and second parts 12 and 14. The cavity 30 has an opening, which faces the interior of the main section. The cavity is in this embodiment essentially cylindrical in shape and here formed as three quarters of a cylinder stretching around the axis of rotation along the bottom end of the phone. The first part 12 includes a ground plane 22, which stretches throughout the main section of the first part 12 along a side of the first part facing inwards, i.e. facing the second part 14 of the phone when the phone is in the closed position. The ground plane 22 essentially extends along the whole length and width of the main section. In the main section there is furthermore provided several units for the different functions of the phone, like for instance a display and a speaker. These units are connected to signal and voltage supply sources via separate connection provided in the hinging section 20. The antenna ground plane 22 stretches into the cavity 30 of the hinging section 20 and there includes a bent section 24 angled away from the part of the ground plane provided in the main section of the first part 12. The bent section 24 includes a first bent section and a second bent section, where the second bent section runs in a plane parallel with the plane of the ground plane in the main section, but distanced in the direction of the second part 14 (when the phone is closed) and the first bent section interconnects the ground plane in the main section and the second bent section in the hinging section 20 at an angle slightly less than 90 degrees. The angle could be higher, like 90 degrees, or lower like say 45 degrees. It is however preferred to have the angle as high as possible that the mechanical structure of the hinging section 20 allows in order to provide a large antenna volume. The antenna element 28 is here provided at a first surface in the hinging section 20 parallel with the second bent section of the ground plane and facing outwards, i.e. facing away from the second part 14 in the closed position, and at a second surface provided essentially at right angles to the first surface directed downwards towards the second bent section of the ground plane at the bottom end of the hinging section, i.e. at the end of the hinging section 20 facing away from the main section. The antenna element 28 could just as well have been curved. The antenna element is provided on the same substrate as the ground plane 22, 24, which is indicated by the antenna element 28 being shown as joined to this ground plane. By the provision of the antenna element 28 and the ground plane 24 In the hinging section 20 a larger mean distance between the antenna element 28 and ground plane in the form of the second bent section in the hinging section is obtained, thus realising a larger antenna volume based on the second height than If an antenna volume based on the first height had been used, which is beneficial from a broadband characteristic point of view, especially since the first and second parts of the phone are relatively thin in clamshell phones. In addition to saving space this embodiment therefore also provides better broadband characteristics because of the increased antenna volume. The ground plane 24 is in the hinging section 20 connected via leads 26 to a ground plane provided in the second part 14 for components and units placed therein. This is beneficial since then a good ground potential aligned with the ground potential of the antenna system is provided for the second part and with a simple interconnection between these ground planes. When the clamshell phone is opened, this furthermore leads to a large antenna ground plane, since the ground plane 22, 24 in the first part is combined with the ground plane in the second part. This enhances the broadband properties of the phone.

An antenna volume is defined between the antenna element and the ground plane. The antenna element 28 is connected via electrical leads to both the ground plane 22, 24 and to an antenna feeding circuit (27) provided in the second part 14 for enabling transmission at suitable frequencies. The connection to the antenna feeding circuit (27) is preferably provided using a coaxial cable also provided via the hinging section. The antenna is therefore a so-called PIFA antenna. In this way the main section is relieved from space, which can be used for other units in the first part, which is in many instances small and has to include lots of units and components for providing all sorts of different functions and features of the phone. It is furthermore possible to even further reduce the size of phone because of this saved space. As is evident from FIG. 2 the thickness of the hinging section is substantially equal to the combined thickness of the first and second parts of the phone.

Figure 3:
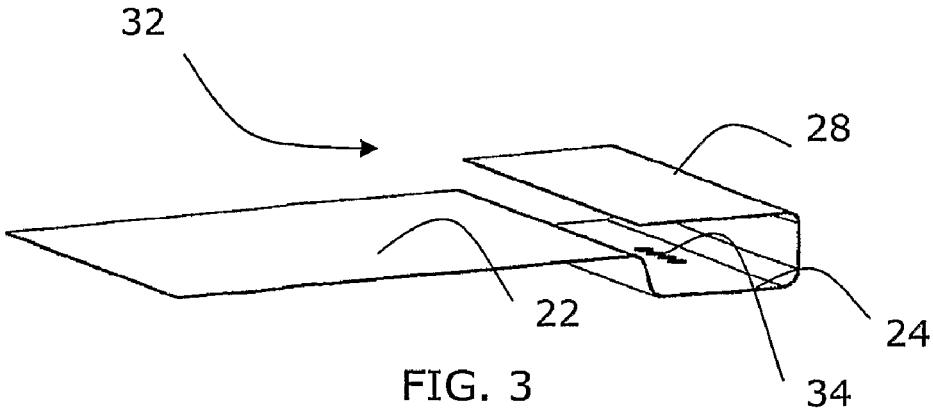
FIG. 3 shows a perspective view of the antenna structure according to the invention for provision in the clamshell phone, FIG. 4 schematically shows a side view of the antenna structure provided on a substrate, FIG. 5 schematically shows a side view of the substrate according to the first embodiment when a display is provided on it.

FIG. 3 shows a perspective view of only the antenna system according to the present invention. Here it is more clearly shown that the antenna element 28 is separated from the ground plane 22 and 24. The figure also shows the electrical connections 34 of the ground plane provided for connection to the radio circuit and to the antenna element 28. These connections are provided in the hinging section, but could be provided anywhere where a connection to the antenna element can easily be made. These are the only connections made from the ground plane to elements in the first part. The ground plane 22, 24 is furthermore provided in one piece. This all in all provides less losses and as a consequence the efficiency of the ground plane is raised as compared with other inbuilt antennas of clamshell phones and of other types of phones.

The ground plane is here provided as a homogenous ground plane in one single piece and is only provided with the necessary connections to the ground plane of the radio circuit in the second part and the antenna element in the first part. It has no holes, conductive traces and no solder points to other components of the first part, which raises the efficiency of the antenna system.

Figure 4:
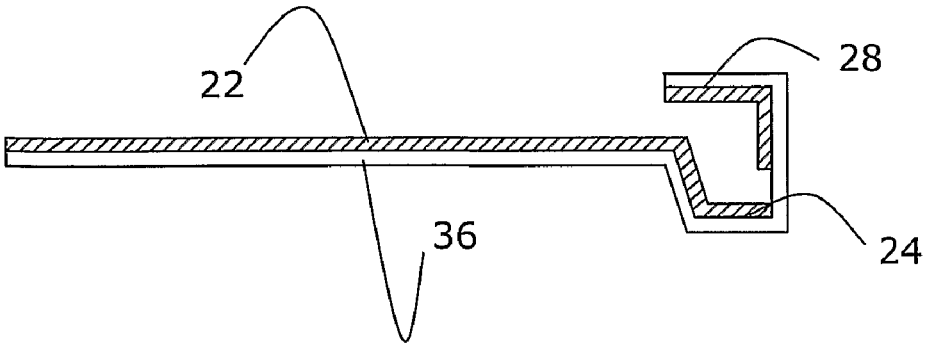

The antenna system according to the present invention is preferably provided from the same piece of material. It can be provided as pieces of sheet metal cut out of the same original piece. It can also be provided through etching or other suitable placing of conductive plates and strips on a substrate. One such substrate is shown in a side view in FIG. 4, where both the ground plane 22 and the antenna element 28 are provided on a substrate in the form of a flex film. By using a flex film it is furthermore easy to bend the structure for fitting in to the interior of the first part.

This flex film used can be the flex film used for a user interface, like for instance for a display of the first part. This solution is shown In a side view in FIG. 5. The substrate 36 is used as a substrate on which the display 38 is placed as well as a film carrying the antenna element and ground plane. In this way the antenna is furthermore made very thin. Another solution is to use the un-perforated magnesium frame provided around liquid crystal display packages. The antenna system according to the present invention can as an alternative be provided on the foil which holds the keypad.

Figure 6:
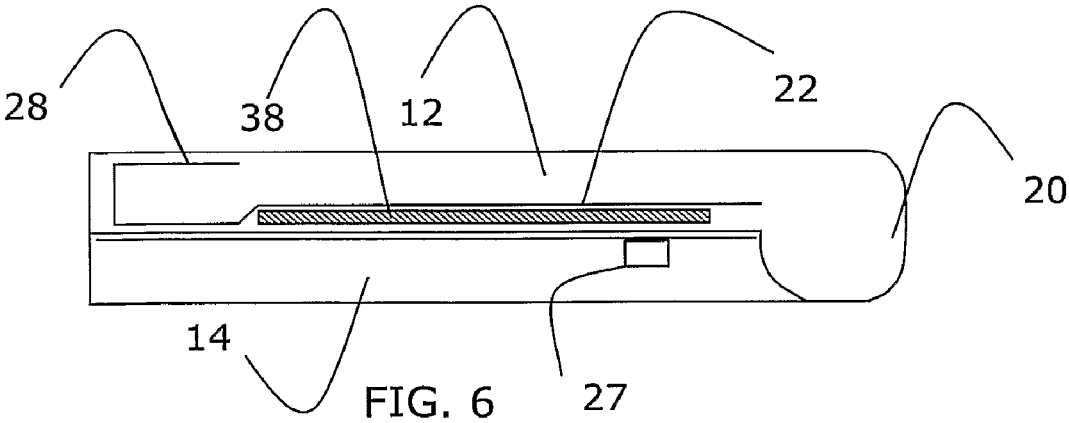
FIG. 6 shows a side view of an antenna system according to a second embodiment of the invention comprising an antenna element and ground plane provided in a first part of the clamshell phone, and FIG. 7 schematically shows a side view of the substrate according to the second embodiment when a display is provided on it.

FIG. 6 schematically shows a side view of the phone according to a second embodiment of the invention that is similar to FIG. 2. Here the antenna element 28 is not provided in the hinging section 20, but rather at the opposite end of the first part 12. The ground plane 22, is a part of the substrate for a display 38 provided on a side of the ground plane facing the second part 14. The ground plane 22 includes a bent section in proximity of the antenna element for increasing the antenna volume beside the display in the end opposite of the hinging section. In this embodiment the ground plane 22 does not stretch into the hinging section, but as an alternative it can just as well do that in order to enlarge the ground plane. The figure also shows the antenna feeding circuit 27.

Figure 5:
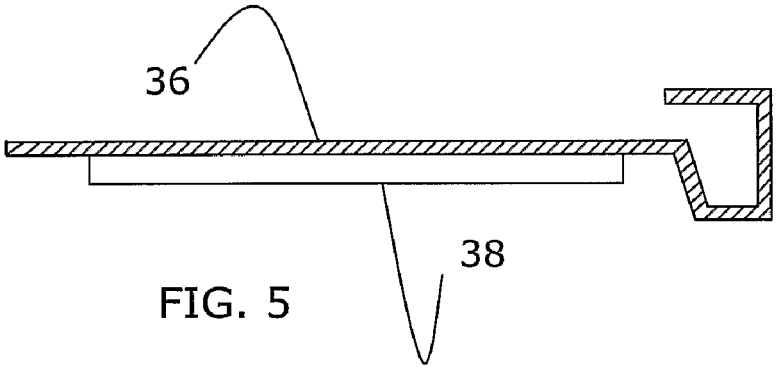
Figure 7:
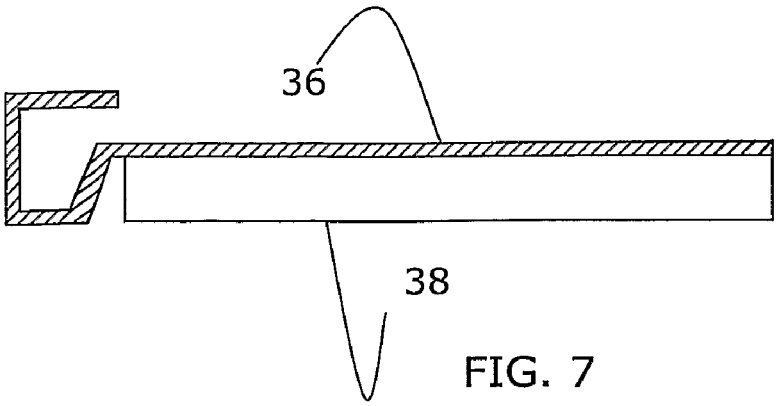

FIG. 7 schematically shows the same type of view for this antenna according to the second embodiment as shown in FIG. 5, with the antenna being provided as an extended layer of the substrate for the display.

The antenna element can be a multiband antenna element. Different examples of antenna systems that can be used are for instance described in EP-application, 03020907.6, which is herein incorporated by reference. In this case the ground plane does furthermore not need to have a bent section, but the ground plane can stretch straight into the hinging section. As an alternative to a PIFA antenna in the first embodiment of the invention, the antenna can be a monopole antenna, in which case the bent section of the substrate might not include a ground plane.

The antenna structure according to the invention has several advantages. It is cheap to produce. It saves space within the first part of the phone, which can be used for other purposes, like more components and other units. When the bent section of the ground plane of the phone that is provided in the hinging section according to the first embodiment is bent away from the ground plane in the first part, a larger antenna volume is obtained, which enhances the broadband characteristics of the phone. Yet another advantage is that by the construction of the ground plane and the antenna element according to the invention it is possible to make the phone not to radiate as much towards the body of a user, which makes the antenna more efficient so that energy is not wasted on this unnecessary radiation. The provision of the ground plane as a single unit with as few as connections as possible to the rest of the first part enhances this effect further and also provides a generally more efficient antenna usage.

The present invention can be varied in many ways in addition to those mentioned earlier. The antenna feeding circuit could as an alternative be provided In the first part. It is possible to add further separate antenna elements to the antenna. The cavity needs not be cylindrical, but can have any other suitable shape. It is however good if it has a height that is larger than the highest possible distance between antenna element and ground plane provided in the first part of the phone. The ground plane, when bent, need not have straight sections, but other ways of providing an Increased distance can just as well be used, like through a cylindrical curvature. More or fewer parts of the antenna element can furthermore be designed in a straight or curved structure. Thus the present invention is only to be limited by the following claims.

The invention claimed is:

1. A portable communication device, comprising:

an antenna feeding circuit;

a first part having a hollow interior, a main section having a width, length and a first height and including a plurality of electrical elements, and a hinging section, wherein the hinging section includes a hollow hinge cavity and has a second height greater than the first height;

a second part connected to the first part, wherein the hinging section provides rotation of the first part in relation to the second part around an axis of rotation; and an antenna system comprising:

an antenna element located within the first part, wherein the antenna element is inside the hinging section; and a ground plane located within and extending along the width and the length of the main section, wherein a portion of the ground plane extends into the hinging section, and wherein the ground plane includes a bent section within the hinging section and bent away from a portion of the ground plane in the main section for providing an increased distance between the ground plane and the antenna element in the hinge cavity corresponding to the second height, wherein the ground plane is provided in one piece, wherein the plurality of electrical elements of the first part includes radio transmission elements electrically connected to said ground plane, wherein the ground plane and the antenna element are provided from a same piece of material on a same substrate, and wherein the antenna element is distanced from the ground plane by at least approximately the first height in a height direction of the first part.

2. A portable communication device according to claim 1, wherein the portable communication device is a cellular phone.

3. A portable communication device according to claim 1, further comprising:

a user interface in the first part, wherein the ground plane and the user interface arranged in the first part are provided on the same substrate.

4. A portable communication device according to claim 1, wherein the ground plane is connected to said second part via the hinging section for providing a common ground potential in both parts.

5. A portable communication device according to claim 4, wherein the antenna feeding circuit is in the second part.

6. A portable communication device according to claim 1, wherein the antenna element is a multiband antenna element.

7. A portable communication device according to claim 1, wherein the antenna element is a PIFA antenna element.

8. A portable communication device according to claim 1, wherein the antenna element is a monopole antenna element.

9. An antenna system for use in a portable communication device, the device having an antenna feeding circuit and a first part with a hollow interior and a main section having a width, length and a first height and including a plurality of electrical elements, the antenna system comprising:

a ground plane located within and extending along the width and the length of the main section; and an antenna element located within the first part, wherein the ground plane is provided in one piece, wherein the plurality of electrical elements of the first part includes radio transmission elements electrically connected to the ground plane, wherein the ground plane and the antenna element are provided from a unitary piece of material on a same substrate, wherein the antenna element is distanced from the ground plane by at least approximately the first height in a height direction of the first part, and wherein the ground plane includes a bent section that is bent away from a portion of the ground plane in the main section for providing an increased distance between the ground plane and the antenna element.

* * * * *